US005545006A

United States Patent [19]

Agahi et al.

[11] Patent Number: 5,545,006

[45] Date of Patent: Aug. 13, 1996

[54] MULTI-STAGE ROTARY FLUID HANDLING APPARATUS

[75] Inventors: Reza R. Agahi, Granada Hills; Behrooz Ershagi, Irvine, both of Calif.

[73] Assignee: Rotoflow Corporation, Gardena, Calif.

[21] Appl. No.: 440,045

[22] Filed: May 12, 1995

[51] Int. Cl.[6] ..... F04D 17/12

[52] U.S. Cl. ..... 415/169.2; 415/178; 415/179; 415/199.1

[58] Field of Search ..... 415/83, 84, 169.2, 415/178, 179, 198.1, 199.1, 199.2, 202, 203

[56] References Cited

U.S. PATENT DOCUMENTS

| | | | |
|---|---|---|---|
| 3,132,493 | 5/1964 | Peckham et al. | 415/198.1 |
| 3,175,756 | 3/1965 | Freevol | 415/199.1 |
| 3,495,921 | 2/1970 | Swearingen . | |
| 3,751,178 | 8/1973 | Paugh et al. | 415/199.1 |
| 3,925,042 | 12/1975 | Hutgens et al. | 415/169.2 |
| 4,231,702 | 11/1980 | Gopalakrishnan et al. | 415/199.1 |
| 4,242,040 | 12/1980 | Swearingen . | |
| 4,300,869 | 11/1981 | Swearingen . | |
| 4,303,372 | 12/1981 | Caffrey | 415/169.2 |
| 4,502,836 | 3/1985 | Swearingen . | |

FOREIGN PATENT DOCUMENTS

| | | | |
|---|---|---|---|
| 155337 | 11/1904 | Germany | 415/199.1 |
| 144384 | 3/1931 | Switzerland | 415/199.1 |

*Primary Examiner*—James Larson
*Attorney, Agent, or Firm*—Lyon & Lyon

[57] ABSTRACT

Rotary fluid handling apparatus employing a wheel to provide multi-stage compression or expansion. A wheel having a first set of vanes includes a shroud about those vanes with a second set of vanes outwardly of the shroud. One set of vanes provides for low specific speed flow while the other set of vanes provides for high specific speed flow. A transfer passage interconnects the outlet of the first stage with the inlet of the second stage. The difference in temperature between the inlet flow to the system and the outlet flow from the system may be exchanged to increase efficiency. The multistage wheel and associated passages may be configured for either compression or turboexpansion.

8 Claims, 2 Drawing Sheets

MULTI-STAGE ROTARY FLUID HANDLING APPARATUS

BACKGROUND OF THE INVENTION

The field of the present invention is compressors and expanders having high pressure ratios requiring multiple stages.

Where high pressure ratios are desired across a fluid handling apparatus in either expansion or compression, more than a single stage may be required. The arrangement and size of the stages in such equipment are determined by gas dynamics, mechanical limitations and dimensional constraints. Such units may employ a single shaft with multiple wheels thereon with the fluid moving from one wheel to the next. Alternatively, multiple shafts may be employed with wheels mounted to each shaft. In the multi-shaft arrangement, a power transmission device is required such as a gear, coupling or the like. The transmission device transfers the torque by coupling the stages together mechanically where significant losses can occur.

The design of wheels in fluid handling apparatus is based on the actual volume of flow, among other variables. The channel shape varies with the intended fluid volume for optimum performance. In rotary fluid handling apparatus technology, the measure of such channel shape variations is reflected in a nondimensional number called specific speed. A wheel with low specific speed will have a narrow, more radial flow channel. A wheel with high specific speed will have a wide channel and a more axial flow. Low and high specific speed wheels have lower efficiency performance than medium specific speed wheels. Specific speed is defined as follows:

$$N_s=(1/H^{3/4})\ RPM\ (ACV)^{1/2}$$

where

RPM rotation speed

ACV actual cubic volume

H turbomachine head

Due to changes in the process fluid in pressure or temperature or both, fluid density may not remain constant. Depending on the compression or expansion duty, the fluid actual volume decreases or increases accordingly. This presents a deviation from the theoretical fluid actual volume for which the wheel was designed, resulting in decreased efficiency.

SUMMARY OF THE INVENTION

The present invention is directed to the combination of low and high specific speed stages on a single wheel of a rotary fluid handling apparatus. Use of a single wheel may permit the design of compact rotary fluid handling apparatus without compromising efficiency. The system also offers a reduction in the number of components, potentially including additional shafts, couplings and the like which create power loss. The use of low and high specific speed stages in one multi-stage wheel also makes dynamic analysis regarding critical speed, torsional and lateral critical speeds, etc. much simpler and less sophisticated. Thus, deviations from the theoretical fluid actual volume are of less significance.

Accordingly, it is an object of the present invention to provide improved rotary fluid handling apparatus. Other and further objects and advantages will appear hereinafter.

DETAILED DESCRIPTION OF THE PREFERRED EMBODIMENT

Figure 1:
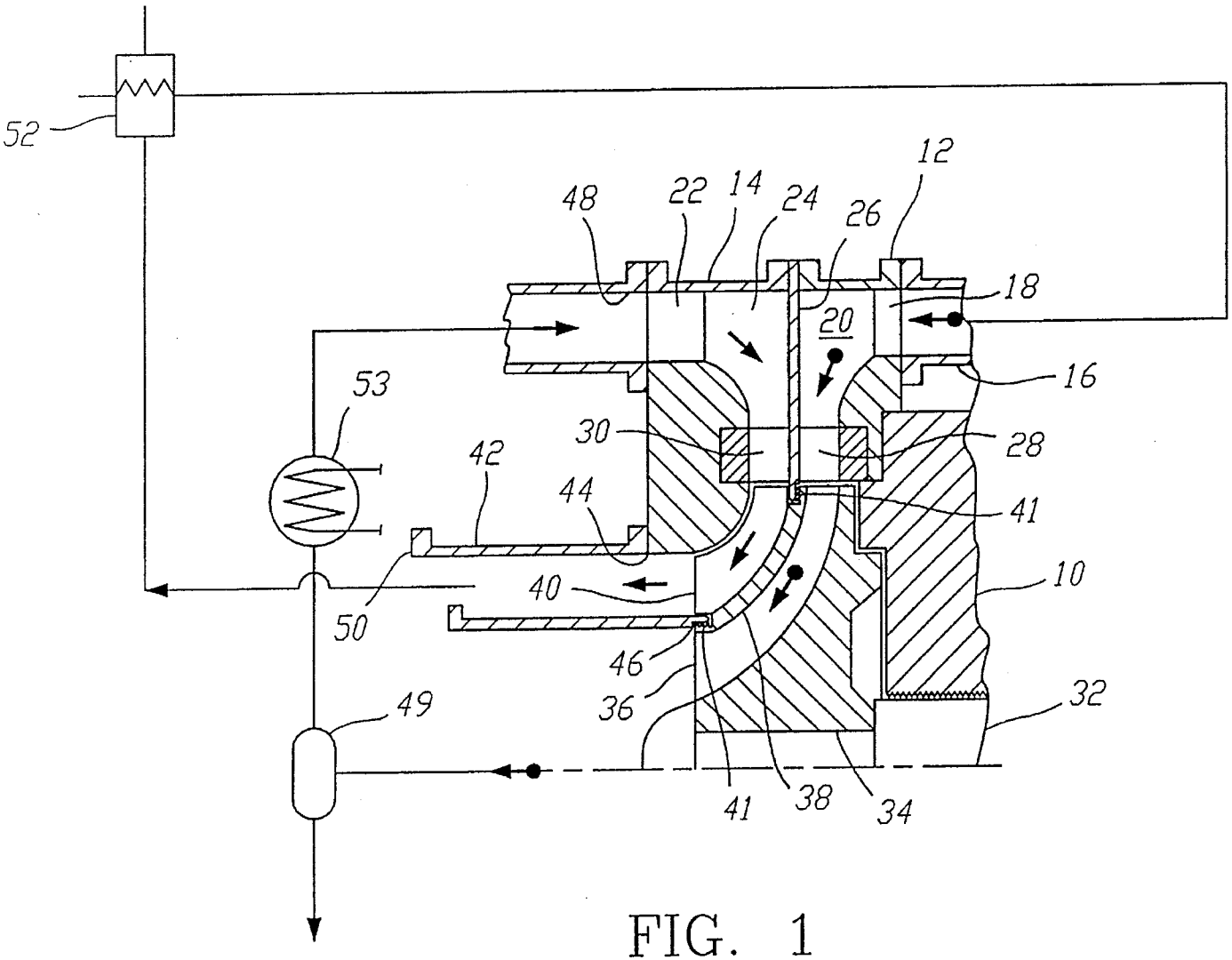
FIG. 1 illustrates a side view in cross section of a multi-stage turboexpander.

Turning to FIG. 1, a turboexpander is illustrated as including a shaft support housing 10, an inlet housing 12 and a transfer housing 14. The inlet housing 12 is coupled with an inlet line 16 directing compressed fluid to the turboexpander. The housing 12 includes an inlet passage 1& to communicate with an inlet manifold space 20 which extends fully about the housing 12.

Similarly, the transfer housing 14 includes a transfer passage 22 and a transfer manifold space 24. The transfer manifold space 24 also extends around the transfer housing 14. To separate the inlet manifold space 20 and the transfer manifold space 24, a disc 26 is fixed between the inlet housing 12 and the transfer housing 14.

Radially inwardly of the inlet manifold space 20 are nozzle blades 28 defining a nozzle for radial inward flow from the inlet. The nozzle may be adjustable. Reference is made to U.S. Pat. Nos. 3,495,921, 4,242,040, 4,300,869 and 4,502,836 describing variable nozzle systems, the disclosures of which are incorporated herein by reference. A similar arrangement of nozzle blades 30 is located radially inwardly of the transfer manifold space 24.

A shaft 32 is rotatably mounted within the shaft support housing 10 and in turn supports a turbine wheel 34. The turbine wheel 34 includes a first set of vanes 36 extending from one side. These vanes 36 define channels between adjacent vanes 36 which are appropriately sized for low specific speed first stage flow through the wheel. A shroud 38 encloses the channels defined between the vanes 36. The shroud 38 is radially aligned with the disc 26. To the other side of the shroud 38, a second set of vanes 40 defines a second set of channels between adjacent vanes 40. Outwardly of the vanes 40 is the transfer housing 14 enclosing the channels between adjacent vanes 40. The second set of vanes 40 may be shrouded as well. The shroud 38 acts to provide sealing between the first and second stage vanes 36 and 40. Labyrinth seals 41 on the shroud 38 cooperate with the disc 26 and a discharge diffuser to separate the two stages of flow.

Affixed to the transfer housing 14 is a diffuser 42. The diffuser 42 includes concentric ports 44 and 46. The port 44 is coincident with the outlet of the transfer housing 14 to accumulate all flow from the channels associated with the second set of vanes 40. The port 46 is aligned with the shroud 38 concentrically inwardly of the port 44 so as to receive all flow exiting from the channels associated with the first set of vanes 36. The diffuser 42 extends from the concentrically inner port 46 to a port 48 where it meets with the transfer passage 22. A liquid separator 49, also known as a knockout drum, may be positioned between the ports 46 and 48, as shown schematically in FIG. 1, to remove condensed liquid. Thus, flow through the vanes 36 is directed around to the transfer passage 22 so as to eventually enter the channels between the vanes 40. Flow from the vanes 40 exiting through the outer concentric port 44 is then directed to an outlet port 50. The diffuser 42 may be arranged such that the discharge from each of the first and second stages may extend horizontally for three pipe diameters to provide a diffuser for recovery of dynamic head as static head.

The turboexpander of FIG. 1 thus provides a low specific speed turbine through the vanes 36 and a high specific speed turbine through the vanes 40 in series. Thus, a multistage turbine wheel is provided for contemplated significant pressure reductions. Naturally, for even more stages, a second such turbine wheel may be arranged to communicate with the outlet 50 in a similar manner.

The system of FIG. 1 may further include a heat exchanger 52 associated with the inlet line 16 and the outlet 50. Cooled flow from outlet 50 is passed on one side of the heat exchanger 52 while the inlet flow through inlet line 16 is cooled. The heat exchanger is preferably designed to accommodate a large differential and flow between the inlet flow side and the outlet flow side. In this way, the inlet flow to the first stage is cooled by the expanded fluid discharged from the second stage. Additional cooling is added to the first stage which results in higher efficiency for low specific speed wheels. Since the low specific speed wheel head is usually larger than that of the high specific speed wheel, by increasing the first stage performance, overall machine efficiency will be increased. Further heat exchangers such as the exchanger 53 schematically shown in FIG. 1 between the knockout drum 49 and the port 48 may be employed where overall system utility and efficiency may be advantaged.

A calculation for a system having two expander stages without the need for removal of condensate provides the following relationships:

| | Stage 1 | Stage 2 |
|---|---|---|
| Process Gas | Hydrogen Rich | Hydrogen Rich |
| Mw | 4.8 | 4.8 |
| $P_1$ (psia) | 500 | 200 |
| $T_1$ (F) | −150 | −200 |
| $P_2$ (psia) | 200 | 150 |
| $T_2$ (F) | −200 | −225 |
| Flow (lb/hr) | 10,000 | 10,000 |
| Enthalpy drop ΔH (BTU/lb) | 101 | 40.5 |
| Volumetric flow $ACFM_2$ | 450 | 870 |
| RPM | 55,000 | 55,000 |
| Specific Speed Ns | 685 | 1880 |

Where:

Mw is molecular weight of process gas;

$P_1$ are the entering and $P_2$ are the exit pressures for each stage; and $T_1$ are the entering and $T_2$ are the exit temperatures for each stage.

Figure 2:
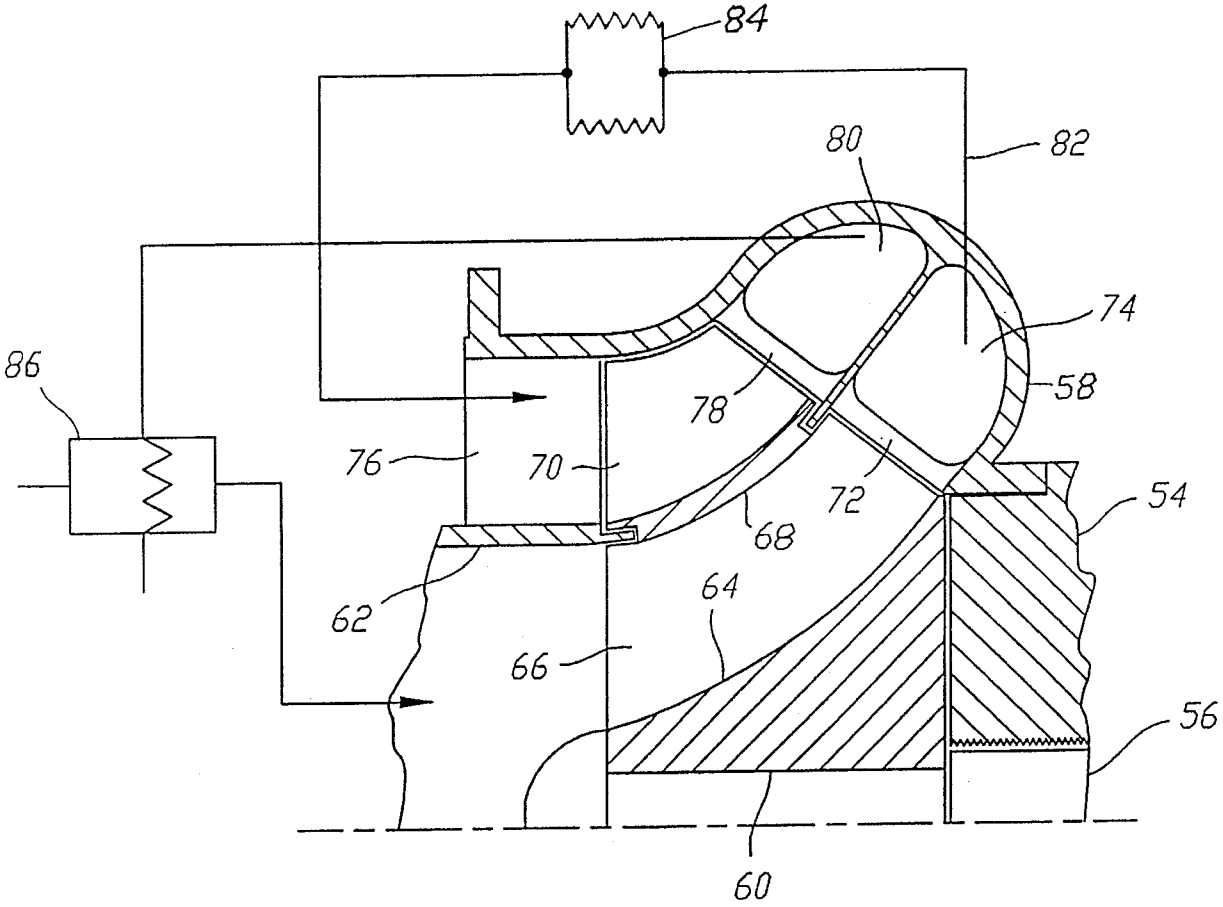
FIG. 2 illustrates a side view in cross section of a multi-stage compressor.

Looking to the compressor of FIG. 2:, a shaft support housing 54 rotably mounts a shaft 56. Mounted to the shaft support housing 54 is an outer housing 58. The outer housing 58 includes an internal cavity for receipt of a compressor wheel 60. An inlet passage 62 is provided axially aligned with the compressor wheel 60.

The compressor wheel 60 includes a hub 64. Vanes 66 extend from one side of the hub 64 and are appropriately configured for compression. Channels are provided between adjacent vanes 66 to draw fluid axially into the compressor wheel 60 and discharge that flow substantially radially. Outwardly of the vanes 66 is a shroud 68. The shroud encloses the channels between the vanes 66. Outwardly of the shroud 68 is another set of vanes 70 also configured for compression of fluids and providing channels between adjacent such vanes 70. This second set of vanes 70 may be shrouded as well. The vanes 66 provide for a low specific speed stage while the vanes 70 provide for a high specific speed stage.

The inlet passage 62 is aligned with the shroud 68 such that inlet flow is directed only to the vanes 66. The outlet from the vanes 66 is provided to a volute defined within the outer housing 58 within a wall 72. The volute terminates at an outlet passage 74.

The outer housing 58 defines an inlet passage 76 which is concentric about the inlet passage 62. The annular inlet passage 76 thus defined is directed to the vanes 70. The wall of the outer housing 58 forms a part of that inlet passage and then extends to enclose the outer portions of the compressor wheel 60. Flow through the vanes 70 is directed to a volute defined within a wall 78 about the periphery of the compressor wheel 60. The volute terminates at an outlet passage 80. To operate the stages of the compressor wheel 60 in series, the outlet passage 74 is in fluid communication with the inlet passage 76. Thus, inlet flow through the inlet passage 62 passes through the first stage of the compressor at vanes 66, exits through the outlet passage 74 through a transfer passage 82 to be fed into the inlet 76 of the second stage through the vanes 70 and then exhausted through outlet passage 80. Appropriate manifolding to allow the inlet 62 to pass through the transfer passage 82 maintains the flows separate. An interstage cooler 84 is shown schematically in the passage 82 which may be used for cooling between stages.

The discharge from the outlet passage 80 in its compressed and heated state may be used to heat the inlet flow to the inlet passage 62 by means of a heat exchanger 86. By cooling the second stage fluid, an increase in the polytropic efficiency of the first stage may be achieved.

A calculation for a system having two compressor stages and an interstage cooler provides the following relationships:

| | Stage 1 | Stage 2 |
|---|---|---|
| Process Gas | Air | Air |
| Mw | 29 | 29 |
| $P_1$ (psia) | 14.7 | 25.5 |
| $T_1$ (F) | 60 | 100 |
| $P_2$ (psia) | 26 | 60 |
| $T_2$ (F) | 182 | 305 |
| Flow (lb/hr) | 20,000 | 20,000 |
| Enthalpy drop ΔH (BTU/lb) | 22.8 | 38.5 |
| Volumetric flow $ACFM_1$ | 4520 | 2800 |
| RPM | 30,000 | 30,000 |
| Specific Speed Ns | 3590 | 1900 |

Where

Mw is molecular weight of process gas;

$P_1$ are the entering and $P_2$ are the exit pressures for each stage; and $T_1$ are the entering and $T_2$ are the exit temperatures for each stage.

Thus, multistage rotary fluid handling apparatus is disclosed using the same wheel for multiple stages. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A rotary fluid handling machine comprising a wheel including a hub, first vanes extending from the hub on a first side thereof, a shroud on the first vanes at a first side of the shroud and second vanes extending from the shroud on a second side of the shroud, the wheel defining a first set of channels between the first vanes and a second set of channels between the second vanes;

a housing about the wheel, the housing including a first inlet to one of the first and the second channels, a second inlet to the other of the first and the second channels, a first outlet to one of the first and the second channels, a second outlet to the other of the first and the second channels;

a transfer passage between the first outlet and the second inlet, the first and the second inlets being to the first and the second channels, respectively, the inlets being about the periphery of the wheel and the outlets being axially of the wheel.

2. The rotary machine of claim 1, the first and the second inlets including first and second nozzles, respectively.

3. The rotary machine of claim 1 further comprising a heat exchanger in the housing having a first side and a second side, the first side being in fluid communication with the first inlet and the second side being in fluid communication with the second outlet.

4. The rotary machine of claim 3 further comprising a liquid separator in the transfer passage.

5. The rotary machine of claim 1 further comprising a liquid separator in the transfer passage.

6. A rotary fluid handling machine comprising a wheel including a hub, first vanes extending from the hub on a first side thereof, a shroud on the first vanes at a first side of the shroud and second vanes extending from the shroud on a second side of the shroud, the wheel defining a first set of channels between the first vanes and a second set of channels between the second vanes;

a housing about the wheel, the housing including a first inlet to one of the first and the second channels, a second inlet to the other of the first and the second channels, a first outlet to one of the first and the second channels, a second outlet to the other of the first and the second channels, the first and the second inlets being to the first and the second channels, respectively, the outlets being about the periphery of the wheel and the inlets being axially of the wheel;

a transfer passage between the first outlet and the second inlet;

a heat exchanger in the housing having a first side and a second side, the first side being in fluid communication with the first inlet and the second side being in fluid communication with the second outlet.

7. A rotary fluid handling machine comprising a wheel including a hub, first varies extending from the hub on a first side thereof, a shroud on the first vanes at a first side of the shroud and second vanes extending from the shroud on a second side of the shroud, the wheel defining a first set of channels between the first vanes and a second set of channels between the second vanes;

a housing about the wheel, the housing including a first inlet to one of the first and the second channels, a second inlet to the other of the first and the second channels, a first outlet to one of the first and the second channels, a second outlet to the other of the first and the second channels, the first and the second inlets being to the first and the second channels, respectively, the outlets being about the periphery of the wheel and the inlets being axially of the wheel;

a transfer passage between the first outlet and the second inlet;

a heat exchanger in the housing having a first side and a second side, the first side being in fluid communication with the first inlet and the second side being in fluid communication with the second outlet;

an interstage cooler in the transfer passage.

8. A rotary fluid handling machine comprising a wheel including a hub, first vanes extending from the hub on a first side thereof, a shroud on the first vanes at a first side of the shroud and second vanes extending from the shroud on a second side of the shroud, the wheel defining a first set of channels between the first vanes and a second set of channels between the second vanes;

a housing about the wheel, the housing including a first inlet to one of the first and the second channels, a second inlet to the other of the first and the second channels, a first outlet to one of the first and the second channels, a second outlet to the other of the first and the second channels, the first and the second inlets being to the first and the second channels, respectively, the outlets being about the periphery of the wheel and the inlets being axially of the wheel;

a transfer passage between the first outlet and the second inlet;

an interstage cooler in the transfer passage.

* * * * *